United States Patent [19]

O'Neill et al.

[11] 3,980,304

[45] Sept. 14, 1976

[54] PORTABLE BATTING PRACTICE CAGE

[76] Inventors: Michael W. O'Neill, 4860 W. 118th St., Apt. 6, Hawthorne, Calif. 90250; Arnold P. Ginsburg, 222 Washington Ave., Apt. 16, Santa Monica, Calif. 90403

[22] Filed: Apr. 26, 1974

[21] Appl. No.: 464,555

[52] U.S. Cl. ..... 273/26 R; 272/3; 273/26 A

[51] Int. Cl.[2] ..... A63B 69/40

[58] Field of Search ..... 273/26 R, 55 R, 55 A, 273/33, 176 F, 101, 29 A, 26 A, 26 D; 272/3, 29; 124/7, 16

[56] References Cited

UNITED STATES PATENTS

| | | | |
|---|---|---|---|
| 3,802,705 | 4/1974 | Burns et al. | 273/101 |

FOREIGN PATENTS OR APPLICATIONS

| | | | |
|---|---|---|---|
| 1,143,873 | 3/1956 | France | 272/3 |
| 1,054,359 | 4/1959 | Germany | 272/3 |

*Primary Examiner*—Richard C. Pinkham
*Assistant Examiner*—T. Brown
*Attorney, Agent, or Firm*—Lindenberg, Freilich, Wasserman, Rosen & Fernandez

[57] ABSTRACT

A trailer adapted to be towed by a prime mover supports at least one batting platform adapted to be stood upon by baseball players, one in each of a plurality of batting areas. A plurality of pitching machine, supported by the prime mover positioned a distance from the batting areas, the prime mover being positioned to project a plurality of baseballs into the batting areas to permit hitting of the baseballs by the players. A structure including poles and cables supports a flexible material around at least the batting areas to provide an enclosure for restraining to a limited area the baseballs pitched by the machine and hit by the players. The batting areas can be transversely aligned at one end of the trailer in which case the pitching machine is positioned in proximity to the other end of the trailer. The batting areas can also be aligned along the length of the trailer in which case the pitching machine is positioned laterally of the trailer.

2 Claims, 11 Drawing Figures

PORTABLE BATTING PRACTICE CAGE

BACKGROUND OF THE INVENTION

1. Field of the Invention

This invention relates generally to sporting equipment and more specifically to batting cages for use by baseball players in practicing batting skills.

2. Description of the Prior Art

One of the most worthwhile skills that can be practiced by a baseball player is his batting skill. Many hours are spent in batting practice not only by the sophisticated players associated with the professional leagues but also the players associated with the children's leagues. In the professional leagues, mechanical ball throwing machines such as that disclosed by Halstead in U.S. Pat. No. 3,724,437, are used to repeatedly and individually hurl a plurality of baseballs into proximity to the practicing batter. These machines are particularly desirable for use in batting practice since they throw the baseballs with a high degree of accuracy. Furthermore, these machines are adjustable in both height and velocity to provide excellent control over the course of the baseball.

These ball throwing machines can be used in cooperation with a batting practice cage such as that disclosed by Flaugh in U.S. Pat. No. 1,591,753. It will be noted that this batting practice cage functions much as a pair of fences having a hood supported therebetween. Although this batting practice cage is portable, there is no restriction on the travel of the baseball in the outward direction. Furthermore, the portability provided by the wheels 27 of the Flaugh cage is restricted generally to a single baseball field. It is not at all adapted for being towed by a truck on a highway between widely spaced baseball fields.

The batting cages of the past have also included ball return means such as that disclosed by Mainers in U.S. Pat. No. 3,306,613. The floor of this batting cage slopes gently from the practicing batter to a trough in proximity to the ball throwing machine. Balls on the floor of this batting cage tend to roll into the trough where they are automatically retrieved and fed into the ball throwing machine. It will be noted that this particular batting cage is not at all portable. It is therefore representative of many of the prior art batting cages which, although they perform a significantly advantageous function, are permanently located at a single position.

It can be seen from the aforementioned patents that the machinery associated with the batting cages of the prior art is particularly complex and therefore quite expensive. For this reason, it is understandable that practice batting cages of this type are normally found only in the major professional leagues.

In order to sharpen the batting skills of the baseball players in the children's leagues, one of the team members, such as a pitcher, is used to repeatedly throw baseballs into the vicinity of a practicing batter. This manner of practice is particularly tiring to the pitcher and can result in injury to his arm. Furthermore, with an understandable lack of skill on the part of the pitcher, the accuracy of the pitching leaves a great deal to be desired. A child, out of mere frustration, will develop bad habits swinging at poorly pitched balls. As a result, this form of batting practice may not be particularly beneficial.

What has been needed in some means for enabling the less sophisticated child players to benefit from the relatively expensive batting practice machinery, a means which does not require a significant initial investment but which can be paid for in small increments by each parent, for example.

SUMMARY OF THE INVENTION

In accordance with the present invention, a practice batting cage is built on a frame which is supported on wheels and provided with a trailer hitch to facilitate the transporting of the frame and batting cage by a prime mover. The frame has a generally rectangular configuration typical of large trailers which are commonly towed on the highways. The batting cage is collapsible into a relatively small size to facilitate the transportation of the cage between various baseball fields throughout a city or county. Upon arrival at a particular baseball field, the batting cage can be easily set up into an operational position in a minimal time such as only 10 minutes.

For a nominal charge, the players of a children's league team, for example, can spend time in the portable batting cage where they can benefit from the use of the relatively expensive ball throwing and ball return machinery. Of particular importance is the fact that the high cost of this machinery can be shared by many baseball teams throughout a city or county so that even the children's teams can benefit from this highly advantageous form of batting practice.

Of particular advantage to the present invention is the ease and simplicity with which the practice batting cage of the present invention can be set up into the operational position and collapsed into the transportable position. In one embodiment, a pair of batting platforms pivot on the frame laterally at one end of the trailer into an operational position wherein they provide horizontal platforms on which the practicing batters can stand. The ball return and ball throwing machinery can be positioned at the other end of the frame of the trailer to hurl the baseballs into a strike zone near the batters. A canvas and net enclosure surrounds the batting platforms and extends into proximity to the ball throwing machines to limit the travel of the throw or hit baseballs.

When the batting platforms are initially lowered into the horizontal, operational position, legs automatically swing from beneath the batting platforms to support these platforms in the horizontal position. The legs automatically maintain a vertical position so that no additional attention is needed to provide this orientation. Once the batting platforms are in place, a pair of gates can be swung into alignment along the back of the batting platforms. A single crossbar can be placed between each of the batting platforms and the associated gate to maintain these structural members in the operational position.

Cables can be strung from the compression members and batting platforms at the rear of the trailer to posts in proximity to the ball throwing machines. These cables provide a supporting structure on which the canvas and net enclosure can be installed. These cables can be automatically provided with a tension when the batting platforms, gates, and compression members are disposed in their operational positions. As a highly desirable consequence, the canvas and net which form the enclosure can be left on the cables even when the batting cage is being transported. At the next baseball field, the batting platforms can be lowered, the gates swung out, and the compression members placed in position. All of this can be accomplished by a single person in only about 10 minutes.

In another embodiment, the batting platforms are permanently constructed in a line along the length of the trailer frame. A poriton of the frame telescopes laterally from the batting platforms to stretch the cables and associated canvas and net in order to form the enclosure. In both of these embodiments, the ball throwing machinery can be disposed either on the frame of the trailer or in the bed of the prime mover. In the latter embodiment, for example, the prime mover carrying the ball throwing machinery would be operationally positioned near the end of the telescoping extension from which position the balls would be thrown toward the batting platforms.

In still a further embodiment, the canvas and net enclosure can be formed by retractable awnings which extend laterally of the batting platforms for connection to the truck carrying the ball throwing machinery.

With any of these embodiments, the batting cage can be transported between the baseball fields in different parts of a city or county, and can be easily set up by a single person in a minimal amount of time. These portable batting cages thereby provide a relatively inexpensive and highly effective batting practice for even the baseball players on the less sophisticated teams.

These and other features and advantages of the present invention will become more apparent with a description of preferred embodiments in conjunction with the associated drawings.

DESCRIPTION OF PREFERRED EMBODIMENTS

Figure 1:
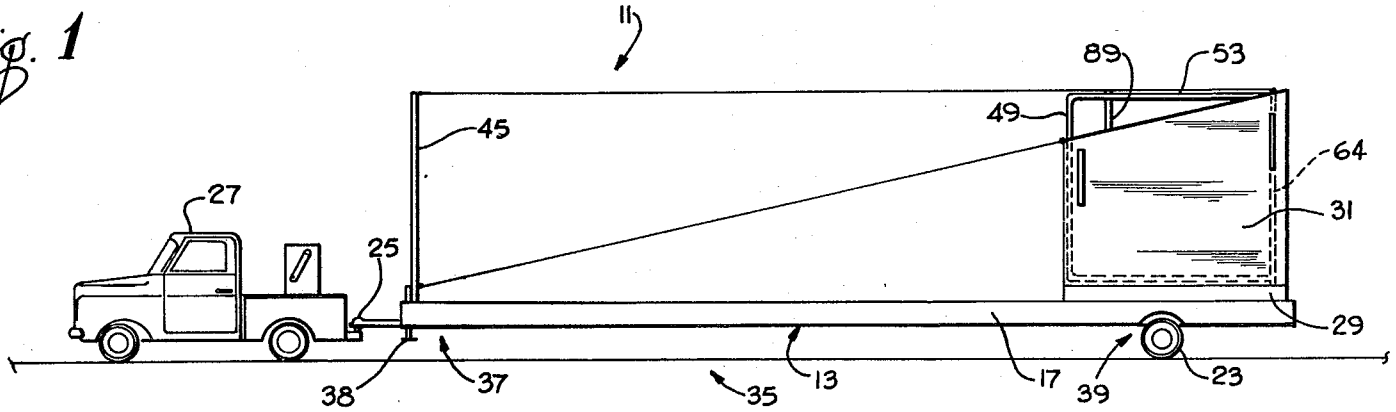
FIG. 1 is a side elevational view of one embodiment of the portable batting practice cage of the present invention, the cage illustrated in a collapsed, transportable position on a trailer behind a tow truck carrying a pair of ball throwing machines.
Figure 4:
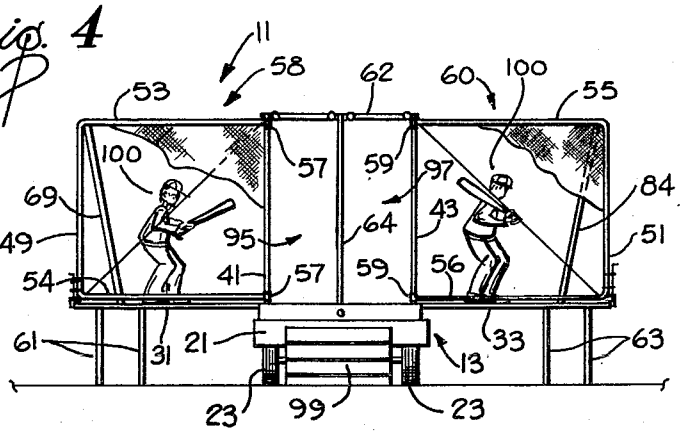
FIG. 4 is a rear elevational view illustrating the batting practice cage of FIG. 1 in the operational position with a pair of baseball players disposed in the batting areas.
Figure 2:
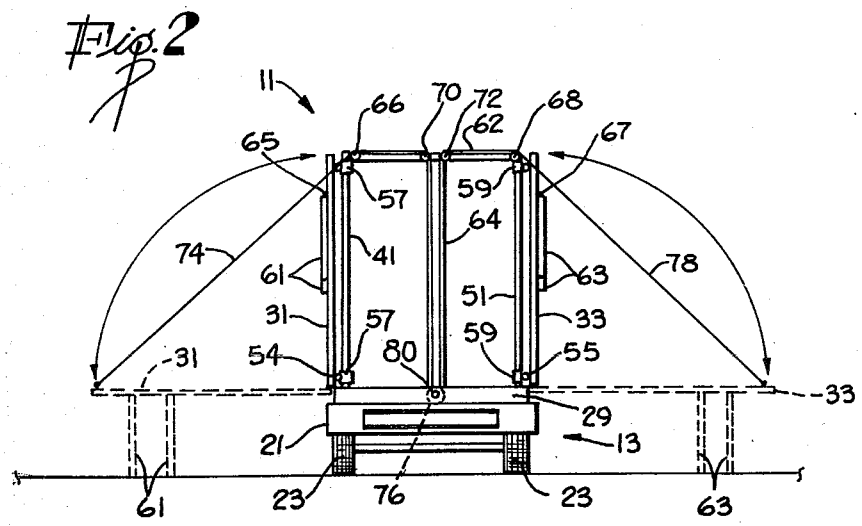
FIG. 2 is a rear elevational view illustrating the ease with which batting platform means of the batting practice cage of FIG. 1 can be set up into an operational position.
Figure 3:
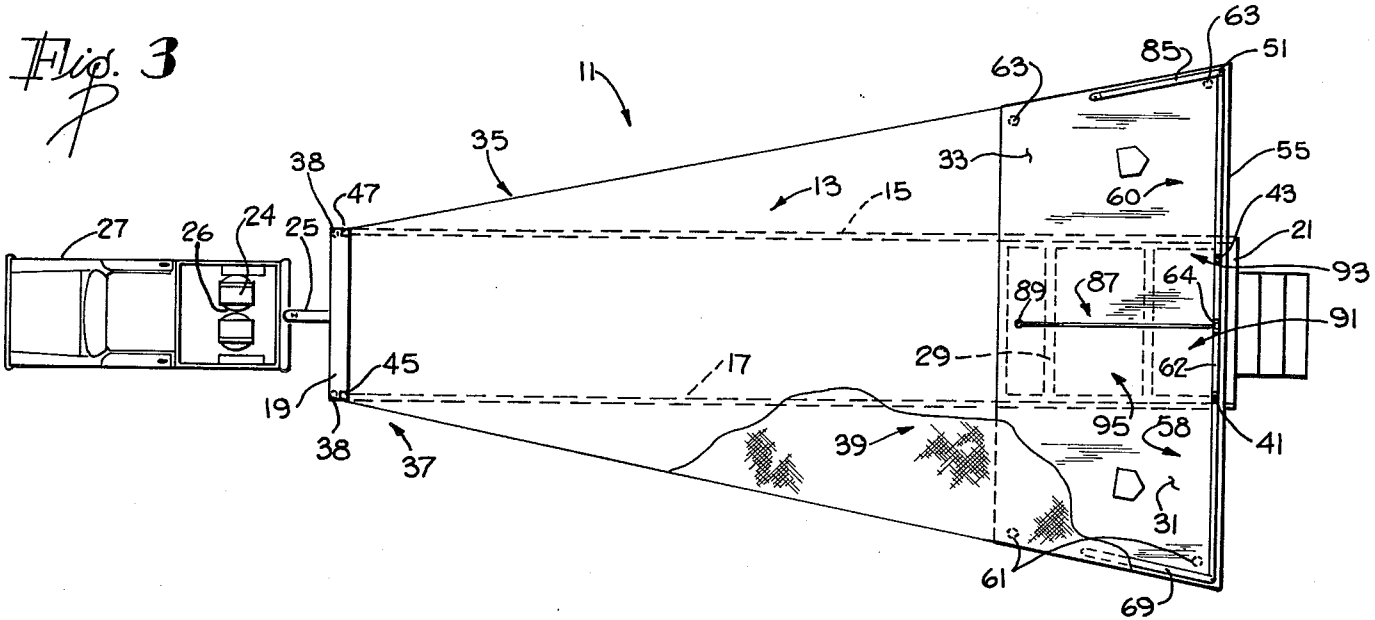
FIG. 3 is a plan view of the embodiment of FIG. 1 illustrating the batting practice cage in the operational position with batting areas aligned transverse to the length of the trailer.

A portable batting practice cage is illustrated in FIG. 1 and designated generally by the reference numeral 11. The batting cage 11 can be easily collapsed into a transportable position as shown in FIG. 1, or set up as shown in FIG. 2, into an operational position as shown in FIGS. 3 and 4. The batting cage 11 includes a frame 13 which can have the configuration of a rectangle, best shown in FIG. 3. In such an embodiment the frame 13 includes a pair of longitudinal members 15 and 17 and at least a pair of transverse member 19 and 21. The frame 13 is mounted on wheels 23 to provide the batting cage with portable characteristics. The frame 13 and wheels 23 collectively define a trailer 35 having a forward end 37 and a rearward end 39.

A conventional trailer hitch 25 is provided at the forward end 37 of the trailer 35 to facilitate the transporting of the cage 11 by a prime mover such as the truck 27. In the transportable position, the batting cage 11 can be confined within the dimensions of legal trailer sizes to facilitate the transporting of the batting cage 11 among various baseball fields throughout a city or county. In the illustrated embodiment, a pair of ball throwing machines 24 are individually mounted on pivotal platforms 26 on the back of the truck 27.

In this particular embodiment, a riser 29 forms part of the frame 13 in proximity to the transverse frame member 21. The riser 29 provides additional elevation so that the top of the riser 29 is at a height such as approximately 3½ feet above ground elevation. In this particular embodiment, a pair of batting platforms 31 and 33 are pivotally mounted on a collapsible portion of the frame 13 at the lateral edges of the riser 29.

A first pair of stationary posts 41 and 43 can be mounted to extend upwardly on the riser 29 in proximity to the corners of the frame 13 defined at the rearward end 39 of the trailer 35. A second pair of stationary posts 45 and 47 can be similarly mounted to extend upwardly at the corners of the frame 13 defined at the forward end 37 of the trailer 35.

A third pair of vertical posts are designated by the reference numerals 49 and 51. The post 49 is supported by a pair of horizontal members 53 and 54 which are pivotally attached to the vertical post 41 by a plurality of hinges 57. Similarly, the post 51 is supported by horizontal members 55 and 56 which are pivotally attached to the vertical post 43 by a plurality of hinges 59. Thus the post 49 and associated horizontal members 53 and 54 form a gate 58 which swings about the vertical post 41. The post 51 and associated horizontal members 55 and 54 form a gate 60 which swings about the vertical post 43.

The portability of the batting cage 11 is a very desirable feature of the present invention, but the ease with which the cage 11 can be set up into the operational position is particularly advantageous. Upon arrival at a baseball field, the hitch 25 of the trailer 35 can be disconnected from the truck 27. Then a plurality of extendable legs 38 at the forward end 37 of the trailer 35 can be lowered to contact the ground and level the trailer 35. After the trailer 35 has been leveled, the batting platforms 31 and 33 can be pivoted from their substantially vertical, transportable position to the substantially horizontal, operational position. This pivoting step can be enhanced by a structure including a horizontal structural member 62 connected between the tops of the posts 41 and 43, and a vertical structural member 64 connected between the horizontal members 62 and the riser 29. A pair of pulleys 66 and 68 can be mounted on the horizontal members 62 at the tops of the respective posts 41 and 43. Similarly, a pair of pulleys 70 and 72 can be mounted on the horizontal member 62 at the top of the vertical member 64.

To further facilitate the lowering of the batting platform 31 into the operational positions, a cable 74 can be connected to the outermost and rearmost corner of the platform 31. This cable 74 can be threaded through the pulley 66, across the horizontal member 62, through the pulley 70, and down the vertical member 64, for connection to an electrical winch 76 beneath the top of the riser 29. Similarly, a cable 78 can be connected to the outermost and rearmost corner of the batting platform 33. This cable 78 can be threaded through the pulley 68, across the horizontal member 62, through the pulley 72, and down along the vertical member 64 for connection to the electrical winch 76. A hole 80 can be provided in the back of the riser 29 to provide access to a mechanical override on the winch 76. It can be seen that by operation of the winch 76, the portable batting platforms 31 and 33 can be easily and safely pivoted on the riser 29 between the vertical, transportable position and the horizontal, operational position.

The simplicity of this setup procedure can be further enhanced by the provision of pairs of legs 61 and 63 which are pivotally mounted on the respective batting platforms 31 and 33 by hinges 65 and 67 respectively. If the legs 61 and 63 are pivotally mounted in this manner, they will automatically seek a vertical position beneath the associated platforms 31 and 33 to automatically support the platforms 31, 33 in the horizontal operating position. The legs 61, 63 may be of the type which are manually extendable to level the platforms 31, 33. In this horizontal position, the batting platforms 31 and 33 provide an extension of the plane defined by the top of the riser 29. Other methods for supporting the batting platforms 31 and 33 in the operational position will be apparent to those skilled in the art although the disclosed method offers simplicity of construction and a minimal setup time.

Figure 5:
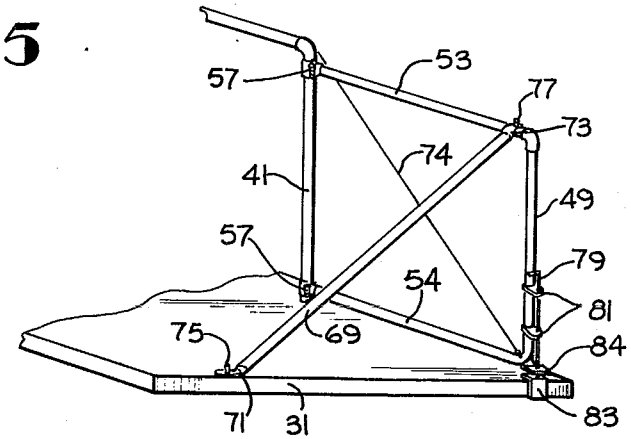
FIG. 5 is a perspective view of an outside corner of one of the batting areas illustrating a portion of the structure supporting the enclosure of the batting practice cage.

Once the batting platforms 31 and 33 have been lowered into their operational position, the gates 58 and 60 can be swung outwardly about the respective stationary posts 41 and 43 to dispose the associated posts 49 and 51 in their operational positions at approximately the outermost and rearmost corners of the associated batting platforms 31 and 33. As illustrated in FIG. 5, the gate 58 can be initially held in its operational position by a conventional lock such as the type best illustrated in FIG. 5 to include a bar 79 slidingly supported in yokes 81 attached to the post 49. A flange 83 attached to the batting platform 31 is provided with a vertical aperture 84 which registers with the bar 79 when the post 49 is in the operational position. A similar type of lock mechanism can be used to maintain the gate 60 in its operational position with respect to the batting platform 33.

Further support for the gate 58 and the batting platform 31 in the operational position can be provided by a structural member, such as the crossbar 69. A pair of flanges 71 and 73 at either end of the crossbar 69 can be provided with holes to register with pins 75 and 77 on the platform 31 and the horizontal member 53 respectively. A similar crossbar 85 can be provided on the opposite side of the cage 11 to maintain the gate 60 and the batting platform 33 in their respective operational positions.

In the operational positions, the swingable posts 49 and 51 are substantially aligned with the stationary posts 41 and 43 along the rearward edge of the cage 11. In the transportable positions, the swingable posts 49 and 51 are substantially aligned with the stationary posts 41, 45 and the posts 43, 47 respectively.

It can be seen that the maximum width of the batting platforms 31 and 33 in the operational position is limited by the maximum height of the platforms 31 and 33 in the transportable position. This maximum height is governed by vehicle regulations. Nonetheless, in this preferred embodiment, batting platforms 31 and 33 form a single planar surface with the riser 29 and this surface has a total width across the back of the batting cage 11 greater than 25 feet. In this particular embodiment, this width is separated into a pair of batting areas 91 and 93 by a verticle partition 87 which is permanently supported between a verticle post 89 and the verticle structural member 64. Thus the post 41, the horizontal member 62, and the verticle member 64 form a doorway 95 into the left batting area 91. Similarly, the post 43, the horizontal member 62, and the verticle member 66 form a doorway 97 into the right batting area 93. Stairs 99 can be positioned beneath the doorways 95 and 97 to enable baseball players 100 to ascend into the batting areas 91, 93.

Figure 6:
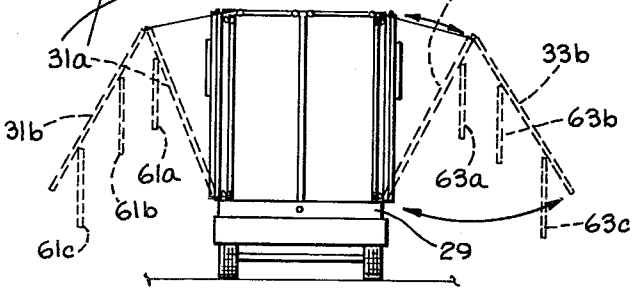
FIG. 6 is a rear elevational view similar to FIG. 2 but illustrating how the batting platform means can be embodied in an accordion shape to provide multiple or enlarged batting areas.

Referring now to FIG. 6, it will be noted that the width of the batting areas can be increased by providing the batting platforms 31 and 33 with an accordian construction. Thus the batting platform means can include a batting platform section 31*a* pivotally mounted to the riser 29 and a batting platform section 31*b* pivotally mounted to the outermost edge of the section 31*a*. On the opposite side of the batting cage 11, the batting platform means can include a batting platform section 33*a* pivotally mounted to the riser 29 and a batting platform section 33*b* pivotally mounted to the outermost edge of the section 33*a*. Additional sections can be added in the accordian configuration to further increase the width of the batting platforms 31 and 33. As illustrated in FIG. 1, a plurality of legs 61*a*, 61*b* and 61*c* can be pivotally mounted beneath the platform sections 31*a* and 31*b* to provide support for the sections 31*a*, 31*b* in the horizontal operational position. Similarly, legs 63*a*, 63*b*, 63*c* can be pivotally mounted beneath the batting platform sections 33*a* and 33*b* on the opposite side of the cage 11.

Figure 7:
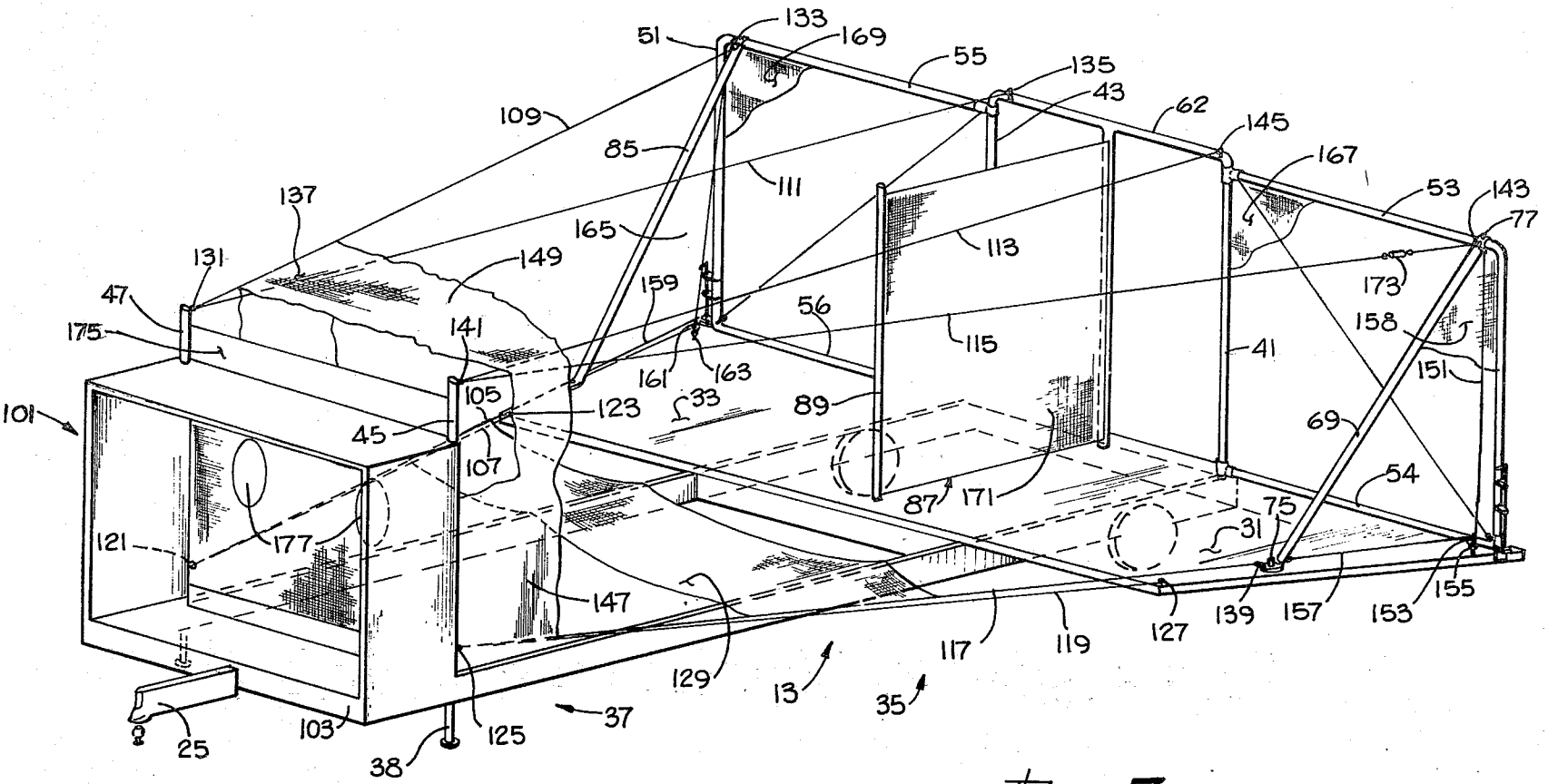
FIG. 7 is a perspective view of a further embodiment of the invention similar to the embodiment of FIG. 1 but with the ball throwing machines mounted on the trailer.

The embodiment of FIG. 1 can be slightly modified as shown in FIG. 7 to provide an enclosure 101 for the ball throwing machines 24 at the forward end 37 of the trailer 35. In this embodiment, the enclosure 101 can be provided with a generally horizontal base member 103 which forms a part of the frame 13, and the trailer hitch 25 of the trailer 35 can be attached to this horizontal member 103.

It is particularly advantageous to provide the batting cage 11 with an enclosure surrounding the batting platforms 31 and 33 and extending into proximity to the ball throwing machines 24. Such an enclosure limits the area within which the balls thrown by the ball throwing machines 24 and the balls hit by the players 100 can travel. The enclosure of the present invention is of particular advantage since it is automatically deployed when the batting platforms 31 and 33 are lowered, the gates 58 and 60 are swung outwardly, and the crossbars 69 and 85 are positioned.

In the present embodiment, the enclosure or cage is formed by guy wires or cables which are designated with consecutively odd numerals between 105 and 119 in FIG. 7. The cable 105 can be attached to an eye 121 which is located at the bottom of the enclosure 101 substantially beneath the post 47. In the embodiment of FIG. 1, this eye 121 can be attached directly to the base of the post 47. The opposite end of the cable 105 can be attached to an eye 123 at the outermost and forwardmost corner of the batting platform 33. The cable 119, which corresponds to the cable 105 on the opposite side of the cage 11, can be similarly attached to an eye 125 at the base of the enclosure 101 beneath the post 45. The opposite end of the cable 119 can be attached to an eye 127 at the forwardmost and outermost corner of the batting platform 31. These cables 105 and 119 support a sheet of canvas, partially shown at 129, which forms the bottom of the enclosure or cage. Thus the sheet of canvas 129 which forms the bottom of the enclosure provides a ball run over which the balls are initially pitched by the machines 24 and along which the balls can be returned to the machines 24.

It is desirable that the canvas 129 slope from the cables 105 and 119 toward the center of the trailer 35, and also slope from the batting platforms 31, 33 toward the forward end 37 of the trailer 35. This will facilitate the collection of balls which fall upon the floor of the enclosure. At the forward end 37 of the trailer 35, the ball throwing machines 24 can automatically retrieve the balls from the canvas 129 to provide for continuous throwing of the balls by the machines 24.

It will be noted that with this construction, the cables 105 and 119 can remain connected to the eyes 121–127 and the canvas 129 can remain supported on the cables 105 and 119 even when the batting platforms 31 and 33 are disposed in the transportable position. Then the floor of the enclosure will be automatically formed by the canvas 129 when the batting platforms 31 and 33 are deployed to the operational position.

The cable 107 can be connected between the eye 121 and the base of the crossbar 85. It follows that the cable 107 will run substantially parallel to the cable 105. The cable 109 can be connected between an eye 131 at the top of the post 47 and an eye 133 at the top of the crossbar 85. Similarly, the cable 111 can be connected between the eye 131 and an eye 135 at the top of the post 43. A single piece of netting 137 can be connected to the cable 107, folded over the cable 109, and connected to the cable 111. Thus the netting 137 forms one of the sides and a portion of the ceiling of the enclosure.

On the opposite side of the batting cage 11, the cable 117 can be connected between the eye 125 and an eye 139 at the bottom of the crossbar 69. The cable 115 can be connected between an eye 141 at the top of the post 45 and an eye 143 at the top of the crossbar 69. Finally, the cable 113 can be connected between the eye 141 and an eye 145 at the top of the post 41. A single piece of netting, partially shown at 147, can be connected to the cable 117, folded over the cable 115 and attached to the cable 113. Thus the piece of netting 147 forms one of the sides and a portion of the ceiling of the enclosure. A rectangular piece of the canvas shown generally at 149 can be stretched between the cables 111 and 113 to form the remaining portion of the ceiling.

As previously mentioned, with reference to FIG. 5, the crossbar 69 registers with pins 75 and 77 to maintain the platform 31 and the post 49 in the operational position. With the cables 115 and 117 attached to the crossbar 69 however, there may be a tendency for the crossbar 69 to lift off the pin 77 at the top of the post 49. For this reason, a preferred embodiment includes a cable 151 attached at one end to the top of the crossbar 69 and at the other end to a hook 153. The hook 153 engages an eye 155 which is fixed to the platform 31. A cable 157 connected from the base of the crossbar 69 to the hook 53 facilitates use of a foot to register the hook 153 in the eye 155. A triangular piece of netting 158 can be stretched between the cables 151, 157 and the crossbar 69 to complete one of the sides of the enclosure.

On the opposite side of the cage 11, a cable 159 can be connected between opposite ends of the crossbar 85 to support a hook 161 which engages an eye 163 mounted on the platform 33. A triangular piece of netting 165 can be stretched between the cable 159 and the crossbar 85 to complete the opposite side of the enclosure.

At the rearward end of the enclosure, a piece of netting or canvas 167 can be stretched between the posts 41, 49 and the horizontal members 53, 54. On the opposite side of the batting cage 11, a piece of netting or canvas 169 can be stretched between the posts 43, 51, and horizontal member 55, 56. The partition 87 between the posts 89 and 64 can also be formed from a piece of netting or canvas 171.

At the forward end of the enclosure, a piece of netting or canvas 175 can be stretched between the posts 45 and 47 and over the rearward face of the enclosure 101. This piece of canvas 175 is provided with a pair of openings 177 through which the balls are initially thrown by the machines 24. The canvas 175 protects the machines 24 against balls hit by the baseball players 100 back toward the forward end 37 of the trailer 35.

The pieces of canvas 129, 167, 171, and 175 can be formed from a vinyl coated nylon such as that manufactured by Cooley, Inc. of Buena Park California, under the catalog number 3022. The pieces of netting 137, 147, 149, 158, and 165 can be formed from a nylon netting having openings approximately 1½ inch square, such as the type manufactured by The Linen Thread Co. of Blue Mountain Alabama, under the catalog number 36 Nylon. Each of the cables 105–119, 151, 157, and 159 can be provided with tensioning means such as a turnbuckle 173 illustrated in the cable 115.

It is of particular importance to note that in this embodiment of the invention, the enclosure formed by the canvas and netting is automatically deployed when the batting platforms 31, 33 are lowered, the gates 58 and 60 are swung outwardly and the crossbars 69 and 85 are positioned. There is no effort or time wasted in stringing cables or stretching canvas during the setup procedure.

Figure 7A:
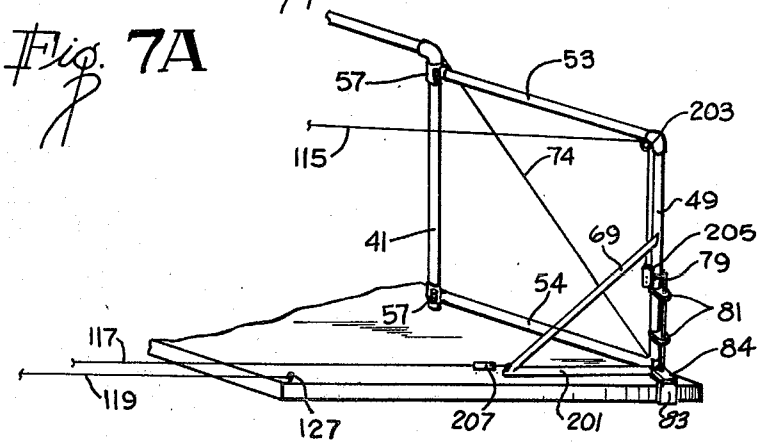
FIG. 7A is a perspective view similar to FIG. 5 showing the outside corner of one of the batting areas in a further embodiment of the invention.

The outside corner of the batting area 31, initially discussed with reference to FIGS. 5 and 7, can also be constructed as shown in FIG. 7A. In this embodiment, the crossbar 69 is held in a rigid, fixed relationship with the vertical post 49 typically by welding. A structural member 201, which replaces the cable 157 in the embodiment of FIG. 5, can be welded between the lower end of the crossbar 69 and the lower end of the vertical post 49. Thus the crossbar 69 and the structural member 201 actually swing with the gate 58.

As compared to the embodiments of FIGS. 5 and 7, the pins 75 and 77, the flanges 71 and 73, the hook 153, the eye 155, the turnbuckle 173, and the cable 151 can be eliminated from the embodiment of FIG. 7A. The pulley 203 can be provided near the top of the post 49 and the cable 115 can be threaded through the pulley 203 downward substantially along the post 49 to terminate at a load binder 205 fixed to the post 49. The load binder 205 is operative between the first and second positions to tension or slack the cable 115. A similar load binder 207 can be provided in the cable 117.

In the operable position, the gate 58 extends along the rearward edge of the platform 31 and the crossbar 69 and structural member 201 extend along the outer edge of the platform 31. Thus the crossbar 69 extends between the platform 31 and the vertical post 49 to maintain these members in the operable position.

When the batting cage 11 is collapsed into its transportable position, the cables 115 and 117 can be slacked by the load binders 205 and 207, respectively, the gate lock including the bar 79 can be released, and the gate 58 pivoted to its transportable position. In this position, the horizontal members 53 and 55 extend longitudinally of the length of the trailer 35, and the crossbar 69 and structural member 201 extend transversely to the length of the trailer 35.

Figures 8, 9:
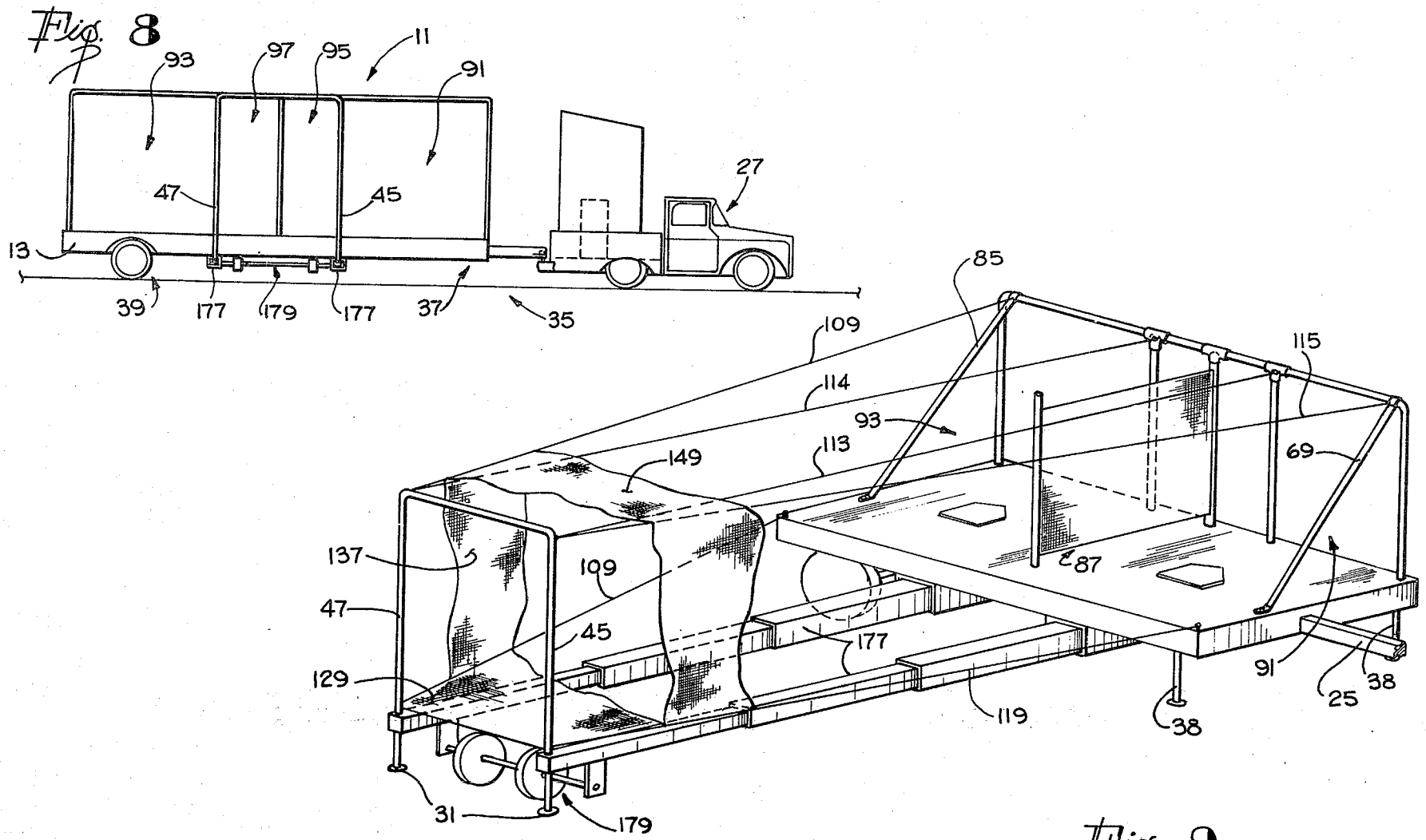
FIG. 8 is a side elevational view of a further embodiment of the batting practice cage in the transportable position wherein the batting areas are aligned along the length of the trailer and the ball throwing machines are carried on the prime mover.
FIG. 9 is a perspective view of the embodiment illustrated in FIG. 8 showing the batting practice cage set up in the operational position with the enclosure partially supported on a telescoping extension of the trailer.

A further embodiment of the invention is illustrated in FIG. 8 wherein the batting cage 11 is shown in the transportable position behind the truck 27. In this particular embodiment, the batting areas 91, 93 are permanently constructed in a line along the length of the trailer 35. The doorways 95 and 97 are provided at the side of the trailer 35 and the batting areas face laterally of the trailer 35. In this embodiment, a plurality of telescoping members 177 form a collapsible portion of the frame 13. These telescoping members 177 can be carried beneath the longitudinal frame members 15, 17 in the transportable position, and can be telescoped laterally of the trailer 35 to support the posts 45 and 47 an extended distance from the batting areas 91, 93. A carriage 179 connected to the telescoping members 177 can be transported in a substantially horizontal position between the telescoping members 177 as shown in FIG. 8. This carriage 179 can be swung into a substantially vertical position to aid in supporting the telescoping members 177 a substantial distance from the batting areas 91, 93 as shown in FIG. 9.

In this particular embodiment, the structure associated with the batting platforms 31 and 33 is permanently constructed on the frame 13 of the trailer 35. Since the trailer 35 may be as long as eighty feet this embodiment may accommodate three or more batting areas, although just the two batting areas 91 and 93 are illustrated in FIGS. 8 and 9.

Since the batting platforms 31 and 33 of this particular invention are permanently constructed, this embodiment may be even easier to set up than the embodiment of FIG. 1. Upon arrival at a baseball field, the operator can swing the carriage 179 into the substantially vertical position to aid in deploying the telescoping members 177 to their extended, operational position. As in the previous embodiment, the cables 105–119 and the associated canvas and net can automatically form the enclosure with the extension of the telescoping members 177. Since the crossbars 69 and 85 are permanently constructed in this particular embodiment, the cables 151, 157 and 159 of the previous embodiment need not be provided. Furthermore, since the batting platforms 31 and 33 are permanently constructed, the cables 74 and 78 and the associated pulleys 66, 68, 70, 72 and winch 78 also can be omitted from this embodiment.

Once the telescoping members 177 have been deployed, the trailer hitch 25 of the trailer 35 can be disconnected from the truck 27. Then the truck 27 can be positioned near the poles 45 and 47 with the ball throwing machines 24 facing the batting areas 91 and 93. By individually supporting the ball throwing machines 24 on the pivotal platforms 26, the machines 24 can be individually aligned with the associated batting areas 91, 93. It will be obvious to those skilled in the art that an enclosure, such as the enclosure 101 illustrated in FIG. 7, could be provided near the posts 45 and 47 to support the ball throwing machines 24 on the telescoping members 177 of the frame 13.

Figure 10:
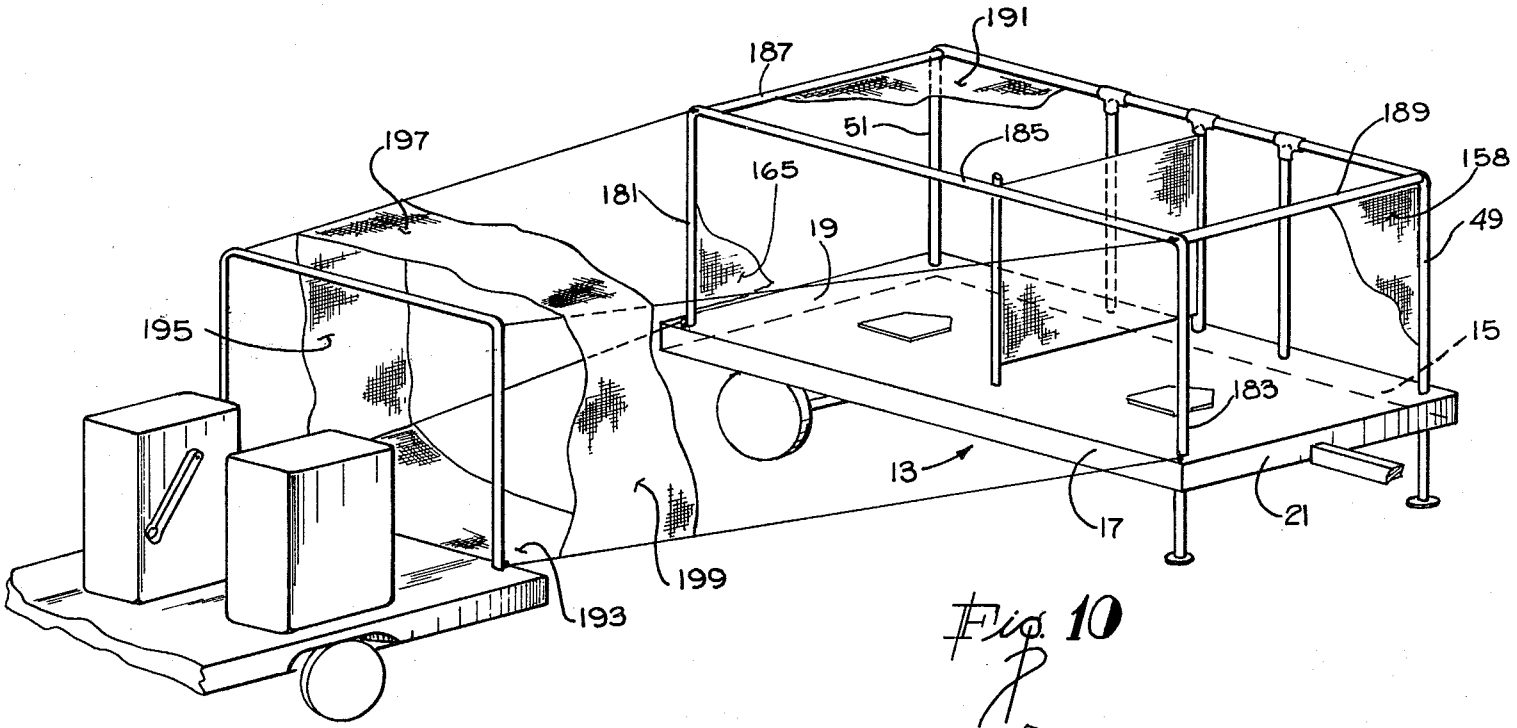
FIG. 10 is a perspective view of still a further embodiment of the batting practice cage wherein a plurality of retractable swings extend laterally of the trailer to engage the truck and form the enclosure.

In still a further embodiment of the invention, the trailer 35 and structure associated with the batting platforms 31 and 33 can be constructed similar to that of the embodiment shown in FIG. 10. In this embodiment however, a pair of vertical posts 181 and 183 can be provided to extend upwardly from the corners defined by the frame members 17, 19 and 21. A longitudinal member 185 can be supported between the tops of the posts 181 and 183, and a pair of transverse members 187 and 189 can be supported between the tops of the posts 51, 181 and the tops of the posts 49, 183, respectively.

The canvas and netting associated with the batting areas 91, 93 can be constructed as previously described except that the permanent piece of netting 158 can be provided with a generally rectangular configuration to fill the entire area defined by the posts 49, 183, the transverse member 187, and the frame member 21. Similarly, the permanent piece of canvas 165 can be provided with a generally rectangular configuration to fill the area defined by the posts 51, 181, the transverse member 187, and the frame member 19. A permanent piece of netting partially shown at 191 can be stretched between the longitudinal members 180, 185 and the transverse members 187, 189.

In this particular embodiment, the remaining portions of the enclosure are formed by pieces of netting 193, 195, 197 and 199 which preferably are retractable into a transportable position in close proximity to the posts 181, 183, the longitudinal member 185, and the frame member 17, respectively. Thus the pieces of netting 193, 195, 197 and 199 form awnings which define the enclosure between the batting areas 91 and 93 and the ball throwing machines 24.

It may also be desirable to mount the ball throwing machines 24, the associated enclosure 101, the posts 45 and 47, and the apertured piece of canvas 175 directly on the truck 27. Then upon arrival at a baseball field, the trailer 35 and the truck 27 can be separated and the truck 27 positioned with the ball throwing machine 24 facing the batting areas 91 and 93. In these respective positions, the pieces of netting 193–199 can be individually extended to releasably engage the eyes 131, 141, 121, and 125 associated with the posts 45, 47. Upon completion of the batting practice, the retractable netting 193–199 can be individually rolled up using conventional automatic or manual awning retraction mechanisms.

The illustrated embodiments of the invention previously discussed are merely representative of the many features and advantages that can be associated with a portable batting cage. Not only is the batting cage 11 portable to facilitate its transportation among several baseball fields, but the setup time at each of the fields is minimized with the simplicity of the constructions discussed. As disclosed, the batting platforms 31 and 33 can be aligned transverse to the length of the trailer 35 at one end of the trailer 35. In such an embodiment, the ball throwing machines 24 can either be carried at the other end of the trailer 35 or in the truck 27. In another embodiment, the batting platforms 31 and 33 are aligned along the length of the trailer 35 and the structure associated with the batting areas 91 and 93 is permanently constructed. The telescoping frame members 177 and associated carriage 179 can be easily deployed to carry the canvas and netting into proximity to the ball throwing machines 24. In such an embodiment the setup time may be even further reduced. In each of these embodiments, the cables, canvas and netting automatically form the enclosure when the collapsible frame members are deployed.

In perhaps a more economical embodiment, the awnings formed from the netting or canvas pieces 193, 195, 197 and 199, can be individually extended to connect directly to the enclosure 101 and the associated posts 45 and 47 carried by the truck 27.

Although the invention has been described with reference to these specific embodiments, it will be apparent that the concepts of the invention can be otherwise embodied so that the scope of the invention should be ascertained only with reference to the following claims.

We claim:

1. A mobile means including a prime mover, and a trailer adapted to be towed by said prime mover;

batting platform means supported by said trailer on which at least one baseball player stands;

pitching means supported on said prime mover an extended distance from said batting platform means for automatically pitching a plurality of baseballs at said batting platform means to permit hitting of said baseballs by a baseball player; and restraining means disposed around at least the batting platform for restraining to a limited area the baseball pitched by said pitching means and a baseball hit by a baseball player standing on said platform.

2. The combination set forth in claim 1 wherein, the trailer is longitudinal in configuration with a first end and a second end;

said batting platform means includes a plurality of batting platform sections aligned transversely to the length of the trailer at the first end of the trailer; and said pitching means is supported by said prime mover in proximity to said second end of the trailer.

* * * * *